United States Patent [19]

Senno et al.

[11] 4,288,260

[45] Sep. 8, 1981

[54] METHOD OF HEAT TREATMENTS OF AMORPHOUS ALLOY RIBBONS

[75] Inventors: Harufumi Senno, Yamatokoriyama; Hiroshi Sakakima, Hirakata; Yukihiro Yanagiuchi, Katano; Tsuneo Inoue, Moriguchi; Masatsugu Yamaguchi; Eiichi Hirota, both of Hirakata, all of Japan

[73] Assignee: Matsushita Electric Industrial Co. Ltd. Osaka, Japan

[21] Appl. No.: 134,132

[22] Filed: Mar. 26, 1980

Related U.S. Application Data

[63] Continuation of Ser. No. 968,969, Dec. 13, 1978, abandoned.

[30] Foreign Application Priority Data

Dec. 16, 1977 [JP] Japan ..... 52/151871

[51] Int. Cl.[3] ..... H01F 1/00

[52] U.S. Cl. ..... 148/121; 148/120; 148/100

[58] Field of Search ..... 148/11.5 R, 13, 13.1, 148/120, 121, 100, 101

[56] References Cited

U.S. PATENT DOCUMENTS

| | | | |
|---|---|---|---|
| 4,052,201 | 10/1977 | Polk et al. | 75/124 R |
| 4,053,333 | 10/1977 | Egami et al. | 148/120 |
| 4,116,728 | 9/1978 | Becker et al. | 148/108 |

FOREIGN PATENT DOCUMENTS 51-73923 6/1976 Japan .

OTHER PUBLICATIONS

"Physical Properties of $Ti_{50}Be_{40}Zr_{10}$ Glass", Tanner et al., Metallurgica, vol. 11, pp. 783–789, 1977.

"Structure Relation and Hardness of Metallic Glasses", Chen et al., Rapidly Quenched Metals, and International Conf. 1976.

"Mechanical Properties of an Amorphous Cu-Zr Alloy", Vitek et al., Metallurgical Transactions, vol. 6A, Jul. 1975, pp. 1472–1473.

*Primary Examiner*—L. Dewayne Rutledge
*Assistant Examiner*—John P. Sheehan
*Attorney, Agent, or Firm*—Wenderoth, Lind & Ponack

[57] ABSTRACT

A method of heat treatments of amorphous alloy ribbons comprises the sequential steps of; grinding amorphous alloy ribbon continuously fed at a predetermined speed (V) selectively varied in the range of 1 cm/sec $\leqq V \leqq$ 50 cm/sec, to uniformly finish the ribbon, and successively, heat-treating the ribbon with its surface contacting a stationary or rotating heating body having a surface temperature (T) defined in the range of $(T_{cry}-200°\ C.) \leqq V \leqq (T_{cry}+50°\ C.)$, where $T_{cry}$ is a crystallization point temperature of the alloy, to uniformly enhance the magnetic properties of the ribbon, and to remove the specific curlings inherently caused by so-called splat cooling manufacturing method, without causing any developments of brittleness of the ribbon mentioned above.

7 Claims, 12 Drawing Figures

METHOD OF HEAT TREATMENTS OF AMORPHOUS ALLOY RIBBONS

This is a continuation, of application Ser. No. 968,969, filed Dec. 13, 1978 now abandoned.

BACKGROUND OF THE INVENTION

This invention relates to a method of heat treating amorphous alloy ribbons, and more particularly, to a method of heat treating amorphous alloy ribbons to uniformly enhance the magnetic properties of the amorphous alloy ribbons, while maintaining the noncrystalline character of the amorphous alloy ribbons.

Recently, thin films of amorphous alloys have been found to be quite useful for technological purposes, and commonly, manufactured through a method in which the melted liquid-alloy is first forced through nozzle means and then, ejected onto a high speed rotating body so as to be instantly quenched thereon.

However, with the above-described method including the so-called splat cooling step, the resultant film formed in a long strip, or more particularly, the amorphous alloy ribbon, generally lacks uniformity with respect to its product-dimensions as well as the specific properties thereof.

As far as the magnetic property is concerned, further proposals to uniformly enhance the magnetic properties of the amorphous alloy ribbons manufactured by the method mentioned above have been proposed.

For example, U.S. Pat. No. 4,053,333 discloses a method for increasing the residual magnetic flux density of the ribbons of nickel based amorphous alloys through a process including the steps of subjecting the ribbons mentioned above to a tensile stress in the range of 20 to 40 kg/mm$^2$, and successively, heating the ribbons mentioned above at a predetermined temperature below the specific melting point or, preferably, in the vicinity of 200° C., for a predetermined duration.

However, the heat-annealing mentioned above can be performed by accommodating the ribbons in an annealing furnace and thereby, maintaining the alloys therein for more than several minutes.

It is, however, to be noted here that, when the ribbons manufactured by the conventional method mentioned above are heat-treated under improperly controlled conditions, without causing any enhancement of the magnetic properties, other mechanical defects occur, particularly, the alloys are rendered brittle.

Furthermore, in respect to the defects concerning the product-dimensions of the amorphous alloy ribbons manufactured through the conventional manufacturing methods including the so-called splat cooling step, the products are to be generally formed with a taper in the direction of the widths thereof, and further, rough surfaces are formed. Therefore, due to the inherent manufacturing defects mentioned above, the amorphous alloy ribbons without any heat treatments, or the amorphous alloy ribbons having enhanced magnetic properties through such simple heat treatments as mentioned above, are not available for making specific products in certain technological fields where high precision in manufacturing the products are required, in spite of the fact that the amorphous alloy ribbons might still have quite acceptable magnetic properties.

SUMMARY OF THE INVENTION

Accordingly, an essential object of the present invention is to provide a method for heat treating amorphous alloy ribbons, by continuously heat-treating the amorphous alloy ribbons to uniformly enhance the magnetic properties of the amorphous alloy ribbons without causing brittleness.

Another important object of the present invention is to provide a method for heat treating amorphous alloy ribbons of the above-described type, which further comprises a grinding process, so that the resultant ribbons may have surfaces finished in a high precision together with a uniform thickness.

A further object of the present invention is to provide a method of heat treating amorphous alloy ribbons of the above-described type, which does not affect the specific mechanical properties of the amorphous alloy ribbons due to the heat treatments.

A still further object of the present invention is to provide a method of heat treating amorphous alloy ribbons, which can be strictly controlled through quite a simple manner and which can be effected in a commercially feasible manner at a low cost.

In accomplishing these and other objects according to one preferred embodiment of the present invention, there is provided a method of grinding and heat-treating long amorphous alloy ribbons manufactured through the conventional splat cooling method which ordinarily have dimensions of 20 to 100 μm in thickness, several centimeters in width, and several tens meters in length.

The method of the present invention comprises the sequential steps of grinding the amorphous alloy ribbon continuously fed at a predetermined rate selectively varied in the range of 1 cm/sec$\leqq V \leqq$50 cm/sec, to uniformly surface the ribbon, and successively, heat-treating the ribbon by contacting it with a stationary or rotating heating body having a surface temperature defined in the range of ($T_{cry}$−200° C.)$\leqq T \leqq$($T_{cry}$+50° C.), where $T_{cry}$ is the crystallization temperature of the alloy, to uniformly enhance the magnetic properties of the ribbon mentioned above, and to remove the specific curlings of the ribbon.

By the process arrangement described in the foregoing, it is possible to accomplish the rapid finish and heat treatments of amorphous alloy ribbons under quite strict controlling conditions. Further specifical effects brought about through the heat treatments according to the present invention are described hereinbelow.

(1) In the heat treatment of the amorphous alloy ribbons having the property of magnetostriction of approximate zero, the magnetic properties of the ribbons mentioned above are enhanced. More specifically, the respective permeabilities specified of the ribbons are increased, while the respective coercive forces are lowered. Furthermore, the permeability of the ribbons are relatively increased in the low range thereof.

(2) In the heat treatment of the amorphous alloy ribbons having the property of positive magnetostriction, the respective coercive forces of the ribbons are lowered, while the respective permeabilities are increased (3) In the heat treatment of the amorphous alloy ribbons having the property of negative magnetostriction, the respective trends or variations of the coercive force and permeability of the ribbons can not be confirmed, and depend upon the conditions involved.

(4) If the magnetic properties the amorphous alloy ribbons are to be enhanced through the conventional heat treatments, e.g., a method of heat treatment by means of an annealing furnace, the resultant ribbons will be rendered brittle. However, according to the present invention, the magnetic properties are enhanced and further, the development of brittleness does not occur, whereby the ribbons heat-treated by the method of the present invention can be mechanically punched without causing any faults, even in the case where a plurality of magnetic cores are to be manufactured.

(5) Although the amorphous alloy ribbons manufactured through the so-called splat cooling method are generally accompanied by a curling phenomenon on their surfaces, the surfaces of the resultant ribbons heat-treated according to the present invention are quite smooth and the successive processing of the ribbons are quite easily accomplished.

(6) According to the present invention, the amorphous alloy ribbons manufactured through the splat cooling method can be instantly heat-treated with the surface of the ribbons being ground at the same time. Therefore, the improvement in the smoothness of the ribbons together with the enhancement of magnetic properties are both brought about at the same time.

BRIEF DESCRIPTION OF THE DRAWINGS

These and other objects and features of the present invention will become apparent from the following description taken in conjunction with the preferred embodiment thereof with reference to the accompanying drawings in which:

FIG. 1(*b*) is a schematic diagram of another embodiment (a movable heating body type) of the method of heat treating amorphous alloy ribbons according to the present invention;

Before the description of the present invention proceeds, it is to be noted that like parts are designated by like reference numerals throughout several views of the accompanying drawings.

DETAILED DESCRIPTION OF THE INVENTION

In the following, a method of heat treating amorphous alloy ribbons of the present invention will be specifically described.

Figure 1:
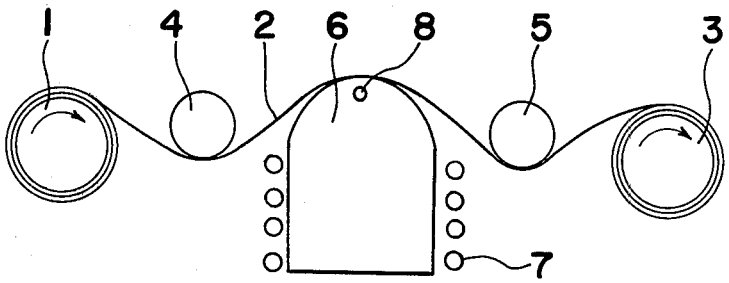
FIG. 1(*a*) is a schematic diagram explanatory of one embodiment (a stationary heating body type) of a method of heat treating amorphous alloy ribbons according to the present invention.
Figure 1:
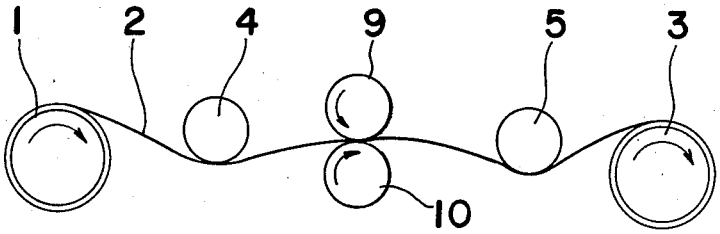

Referring now to FIG. 1, there are shown basic constructions of the preferred embodiments of the present invention, which can accomplish the method of heat treating the amorphous alloy ribbons of the present invention. More specifically, FIG. 1(*a*) shows one embodiment, wherein a heating body, which will be specifically described hereinbelow, is a stationary type, while FIG. 1(*b*) shows the other embodiment, wherein the heating body is a movable type.

One of the preferred embodiments specifically shown in FIG. 1(*a*) comprises a supply reel 1, to which ribbon or ribbon-shaped thin film of a magnetic amorphous alloy 2 is being bound, a take-up reel 3 of the ribbon-shaped thin film 2 mentioned above, a heating body of stationary type 6 which is made of heat resistant steel and interposed between the supply reel 1 and the take-up reel 3, and a pair of guides 4 and 5, one of which is disposed between the supply reel 1 and the heating body 6, while the other is disposed between the take-up reel 3 and the heating body 6, respectively. The manner of disposition of these two guides are so arranged that these are capable of properly guiding the ribbon-shaped thin film along the predetermined transferring passage therewith, and further, urging the ribbon-shaped thin film to contact a surface of the heating body therewith.

Furthermore, as is seen in FIG. 1(*a*), the embodiment mentioned above includes a heating coil 7 and a hole 8 for temperature detection of the heating body 6.

According to the embodiment of the present invention, the ribbon-shaped thin film of magnetic amorphous alloy is to be transferred at a predetermined feeding velocity, with at least one surface of the amorphous alloy ribbon contacting a surface of at least one heating body 6 which is maintained at a predetermined constant temperature, whereby the amorphous alloy ribbon or the ribbon-shaped thin film of magnetic amorphous alloy 2 is heat-treated without causing any operational interruptions thereof.

In contrast with the embodiment shown in FIG. 1(*a*), according to the embodiment shown in FIG. 1(*b*), a heating body 9 for this case takes a form of roller type and is paired with an urging roller 10 so that the ribbon-shaped thin film of magnetic amorphous alloy 2 is pressed against a surface of the heating body 9. Naturally, the roller 10 may be replaced by another heating roller, whereby the two rollers are resultantly composed of a pair of heating rollers.

By the arrangement described in the foregoing, the heat-treatment of the ribbon-shaped thin film of magnetic amorphous alloy can be effectively accomplished within quite a short duration which can not otherwise be brought about through conventional concepts concerning heat-treatments of the alloy mentioned above. According to the conventional method mentioned above, the object to be heat-treated should be kept under a certain predetermined temperature condition for at least more than several minutes or hours. More specifically, the object to be heat-treated is to be brought into a thermodynamically equilibrium state at a predetermined temperature. As a matter of fact, the above-mentioned state can only be relatively easily accomplished, when the temperature of the heating body is high enough. However, when the temperature of the heating body is comparatively low, it takes quite a long time or, sometimes an infinite time for the object to be heat-treated to be brought into the thermodynamically equilibrium state mentioned above, whereby the perfect accomplishment of the above-mentioned state can not be actually brought about.

Furthermore, as long as the object to be heat-treated is a magnetic amorphous alloy, the internal transport phenomenon from the amorphous state to the crystalline state (thermodynamically stable state) generally takes place during a certain clapse of time, since the magnetic amorphous alloys are ordinarily brought about by quenching alloys in an unstable state. In spite of the fact mentioned above, as far as some kinds of amorphous alloys are concerned, the transport phenomenon which takes place at the room temperature with respect to the elapse of time is negligibly small. Therefore, in the course of heat-treating process, if the amorphous alloys of the above-described type are selectively quenched through a staged-wise quenching process, alloys having different crystalline states and characteristics can be obtained.

Figure 2:
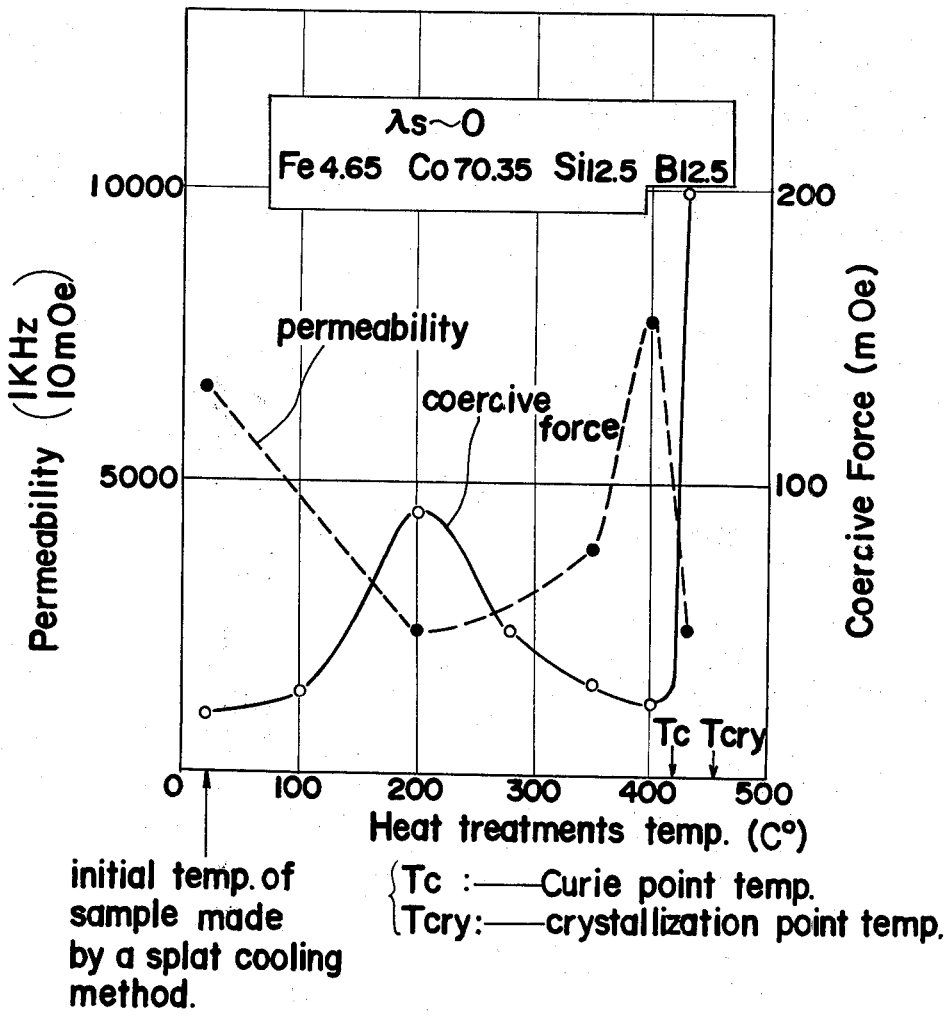
FIG. 2 is a graph particularly showing variations of the magnetic property characteristics of the amorphous alloy ribbon of $\lambda_s \sim 0$ in the course of the heat treatments, according to a conventional heat treatments method, i.e., a method of heat treatment by means of a annealing furnace.

Referring now to FIG. 2, there is shown a graph particularly showing the magnetic property characteristics of an amorphous alloy ribbon which was heat-treated by the conventional method of heat-treatment with an annealing furnace. The amorphous alloy ribbon chosen for the above-mentioned purpose is a typical amorphous material of high permeability and its composition is expressed by the following chemical formula.

$Fe_{4.65}Co_{70.35}Si_{12.5}B_{12.5}$ (saturation magnetostriction $\lambda_s=0$)

The Curie point ($T_c$) and crystallization point temperature ($T_{cry}$) of the above-mentioned sample are 417° C. and 502° C., respectively. The sample of the quenching experiment is held for about 10 minutes at respective predetermined quenching temperatures.

As is clear from the description in the foregoing, the coercive force of the sample-material manufactured through a rapid quenching or a so-called splat cooling method tends to increase following the successive heating of the sample-material mentioned above from the room temperature up to about 200° C., while the permeability of the sample material shows the reverse temperature characteristics.

However, the temperature characteristics of the respective coercive force and permeability of the sample material mentioned above will show the reverse trends, when the temperature of heat-treatments exceeds 300° C., wherein, following the increase of the temperature of the heat treatment, the coercive force is decreased while the permeability is increased. Furthermore, as for the mechanical properties of the sample-material mentioned above, the material is rendered brittle when the temperature exceeds 300° C., and rendered even further brittle at temperatures in the vicinity of 400° C. to such an extent as to be easily broken, for example, by a slight touch of the hand. Above the temperature of 400° C., the crystallization is gradually developed as the temperature is increased, wherein the coercive force is again increased, while the permeability is enormously decreased.

The graph mentioned above shows a typical example of the heat-treatment effects of an amorphous alloy having a high permeability.

According to the method of heat-treatment of the present invention, various amorphous alloys having advantageous characteristics are to be produced as described hereinbelow, depending upon the respective magnetostrictions of the sample-materials employed for the present heat-treatments.

(I) When the magnetostriction ($\lambda_s$) of the sample-material is positive, the permeability of the sample-material tends to increase, while the coercive force tends to decrease.

(II) When the value of magnetostriction ($\lambda_s$) of the sample-material employed is in the vicinity of 0, the permeability of the sample-material tends to increase while the coercive force tends to decrease. As far as the level characteristic is concerned, the rate of increase of permeability is enormously large in the vicinity of the low level thereof.

(III) When the magnetostriction ($\lambda_s$) of the sample-material employed is negative, the respective trends of variation in the respective permeability or coercive force are not stable and depend upon the conditions invalued.

Furthermore, as for one of the most advantageous results brought about by the heat treatments of the present invention, the magnetic characteristics of the amorphous alloys are enhanced and brittleness does not occur, which otherwise occures in the conventional methods. These characteristics mentioned above are quite important, when the magnetic amorphous alloys are to be used in magnetic circuit components. Moreover, although the surfaces of conventionally ribbon-shaped thin films of amorphous alloys, which are manufactured through the splat cooling method, are commonly twisted to some extent, the occurrence of such twists is prevented according to the present invention and thereby, ribbon-shaped thin films of the amorphous alloys can be produced which are flat, are obtainable.

It is quite important for the ribbon-shaped alloys mentioned above to be smoothly surfaced, when these ribbon-shaped thin films of magnetic amorphous alloys are to be layered or laminated so as to constitute magnetic circuit components therewith. Furthermore, when the heat-treatment of the present invention is to be performed, the magnetic properties of the ribbon-shaped thin films can be enhanced by applying a magnetic field to the ribbon-shaped alloys with the direction of the flux of the magnetic field being arranged to be either in a longitudinal direction or in a lateral direction in respect to the ribbon-shaped thin film.

As will be further made clear, according to the method of the present invention, the ribbon-shaped thin film of the amorphous alloy is heat-treated in a temperature range close to that of the crystallization point temperature thereof, with the amorphous character of the alloy remaining unchanged, whereby the eminent effects of the heat-treatment of the ribbon-shaped thin films mentioned above can be specifically brought about.

However, in the following, as a pre-step in the heat treatment of the amorphous alloy ribbons, the amorphous alloy ribbons manufactured through the so-called splat cooling method are subjected to a grinding step. More specifically, a method for forming the amorphous alloy ribbons, which have a uniform width together with a fine surface without any curlings is provided herein.

Commonly, the splat cooling method for manufacturing amorphous alloy ribbons are divided into three types, such as the splat cooling of a centrifugal drum type, the splat cooling of a single roller type, and the splat cooling of a rolling type. However, these methods are not very effective for producing satisfactory ribbons. More specifically, these methods do not prevent the occurrence of the specific manufacturing defects, in which the amorphous alloy ribbon is tapered in the direction of the width thereof and has rough surfaces. Due to these inherent manufacturing defects, the amorphous alloy ribbons can not be used in certain technological fields in which a high precision is required for a products-finish, in spite of the specific property characteristics of the amorphous alloy ribbons described in the foregoing.

More specifically, according to the amorphous alloy ribbons manufactured by, for example, the single roller type, the state of a surface, which has been contacted by the roller, is quite different from that of the opposite surface which has been free from the contact of the roller, i.e., the free surface. With the method mentioned above, the contact-surface can be surface-finished with the surface roughness being less than $\pm 5$ $\mu$m under severe manufacturing conditions, while the free surface, in spite of its surface brightness, can not often help having quite a rough surface of the surface roughness of more than $\pm 10$ $\mu$m. Moreover, the tapering difference to in the direction of the ribbon-width is often over 10 $\mu$m, as far as the ribbons having a width of 10 mm are concerned, and, furthermore, the respective widths of the leading portion together with the trailing portion of the ribbon manufactured by the method mentioned above often have respective widths more than 10 $\mu$m.

As for the ribbons manufactured by the rolling type, although the difference in surface roughness between the free and contact surfaces mentioned above can not be brought about, once undesirable cuts are formed on the surfaces of the rollers made of rather harmful material, these cuts are depressed to leave prints on the surfaces of ribbons and thereby, cause the surface roughness of ribbons to be more than 10 $\mu$m.

Accordingly, a new reforming method of producing amorphous alloy ribbons manufactured by the splat cooling method, free of the above disadvantages is in order.

According to the reforming method of the present invention, the surface roughness of the amorphous alloy ribbons is small having a value of $\pm 2$ $\mu$m. The amorphous alloy ribbons thus reformed by the method of the present invention have highly precise dimensions, and therefore, can be used in a magnetic core of a video-head, magnetostriction delay circuit, in a magnetic core of laminated type of audio-head, or in a magnetic core of a transmitter constituted by a number of laminated layers.

The reforming method mentioned above comprises either one or, the both of the steps below in a sequential manner.

(1) The amorphous alloy ribbons are first ground either by mechanical grinding method or by an electrolytic polishing method, until the alloys have a surface roughness less than $\pm 2$ $\mu$m. More specifically, the grinding step is performed without any operational interruptions, as if the tape of the amorphous alloy ribbons was continuously fed inside the magnetic tape recording head without any interruption when the magnetic tape-recorder is in operation. However, the ribbon manufactured and ground by the method mentioned above is generally curled in the direction of the width thereof, due to the fact that there occurs an unbalanced phenomenon in an internal stress between the stress exerted along the surface ground and that exerting along the other surface and thus the surface ground side is inevitably protruded. As far as the improvement in precision of the amorphous alloy ribbons is concerned, the curling phenomenon mentioned above brings about problems when the amorphous alloy ribbons are used. Therefore, the following treatments are to be further applied to the amorphous alloy ribbons.

(2) The amorphous alloy ribbons which have already been ground so as to be reformed as described in the foregoing is successively heat-treated through a step of contact with the above-mentioned heating body for quite a short duration. Owing to the two steps described in the foregoing, the specific curling accompanied by the grinding operation is removed and thereby, an amorphous alloy ribbon having quite a smooth surface a non-curling uniform state and enhanced magnetic properties, can be now manufactured.

Furthermore, the simultaneous accomplishment of the above-mentioned steps, without causing any interruption with respect to the manufacturing process, naturally brings about quite effective manufacturing results. Further advantages with respect to the manufacturing results can be brought about by the further arrangements concerning every step as will be described hereinbelow, depending upon the fact that the thickness of the amorphous alloy ribbon is generally less than 50 $\mu$m.

Figure 3:
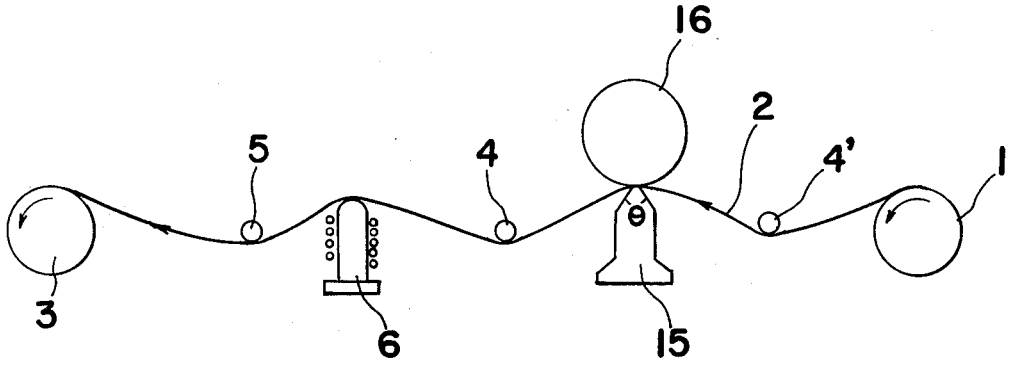
FIG. 3 is a schematic diagram of other embodiment, which further includes a grinding step therein, of the method of heat treating amorphous alloy ribbons according to the present invention.

As far as the step of grinding is concerned, a portion of the amorphous alloy ribbon which is contacted with a grindingstone, is not only to be maintained in a stretched state, but also to be in contact with the grindingstone mentioned above, constituting an acute angle therebetween so that the portion is effectively contacted by the grindingstone. More specifically, as shown in FIG. 3, the thickness of the ribbon to be reformed can be much better controlled by the introduction of a supporting stock for grinding 15 whose contacting surface is formed to have a predetermined curvature, when compared with that reformed by the conventional supporting stock for grinding having a plain grinding surface. As for the vertical angle ($\theta$) of the supporting stock for grinding, an angle ranging between $10° \leqq \theta \leqq 150°$ is most preferable for the optimum grinding operation with respect to a precise finish. As a matter of fact, it is not possible to choose the vertical angle ($\theta$) less than 10°, while a choice of vertical angle ($\theta$) more than 150° will cause entrainments of the grinding waste stuff, and the resultant stagnation of the grinding lubricating oil, and resulting in an improper rough surface-finish.

Moreover, the grinding speed enormously affects the surface roughness of the resultant amorphous alloy ribbons. According to the experimental results which were carried out in the course of completion of the present invention, the surface roughness becomes more than $\pm 5$ $\mu$m when the grinding speed exceeds a speed of 10 cm/sec, while the rate of manufacturing process slows down when the grinding speed is less than 0.1 cm/sec. By the results mentioned above, the most preferable grinding speed is about the speed of 1 cm/sec when considered in connection with the successive step of heat treatment.

As described in the foregoing, the heat-treatment step can not be accomplished at a sufficiently high temperature beyond the crystallization point temperature ($T_{cry}$°C.) of the amorphous material. According to the experimental results mentioned above, the most effective state, in which not only the occurrence of curling phenomenon is prevented, but also the magnetic properties of amorphous magnet material are enhanced, is brought about when the temperature (T°C.) of the heating body is arranged to be in a temperature range including the crystallization point temperature therein and defined by the following formula, i.e., $T_{cry}-200°$ C. $\leqq T \leqq T_{cry}+50°$ C. More specifically, when T is less than ($T_{cry}-200°$ C.), the heat-treatments are not effective for the above-mentioned purpose, while the crystallization begins to take place when T is more than ($T_{cry}+50°$ C.). Therefore, the most preferable temperature exists between two limits of the temperatures mentioned above. Otherwise, after the completion of the reforming process of the amorphous alloy ribbon, the enhancement of magnetic proper properties of the ribbon is naturally brought about, if the magnetic field is simultaneously applied to the ribbon in the course of step of the heat treating.

FIG. 3 further shows a basic arrangement of the present invention, which comprises a supply reel 1, an amorphous alloy ribbon 2, the grindingstone 16 which grinds one-side surface of the ribbon mentioned above, a supporting stock for grinding 15 having the above-mentioned vertical angle of $\theta$, a heating body 6 for heat-treating or more specifically, annealing the ribbons 2 continuously fed from the step of grinding, the take-up reel 3, and a plurality of the guides or pins 4, 4' and 5, to support and further cause the ribbon to be in the tensile state along the predetermined transferring the passage of the ribbon 2.

In the following, a plurality of examples of methods of heat treating the amorphous alloy ribbons according to the present invention will be specifically described in detail.

EXAMPLE 1

Figure 4:
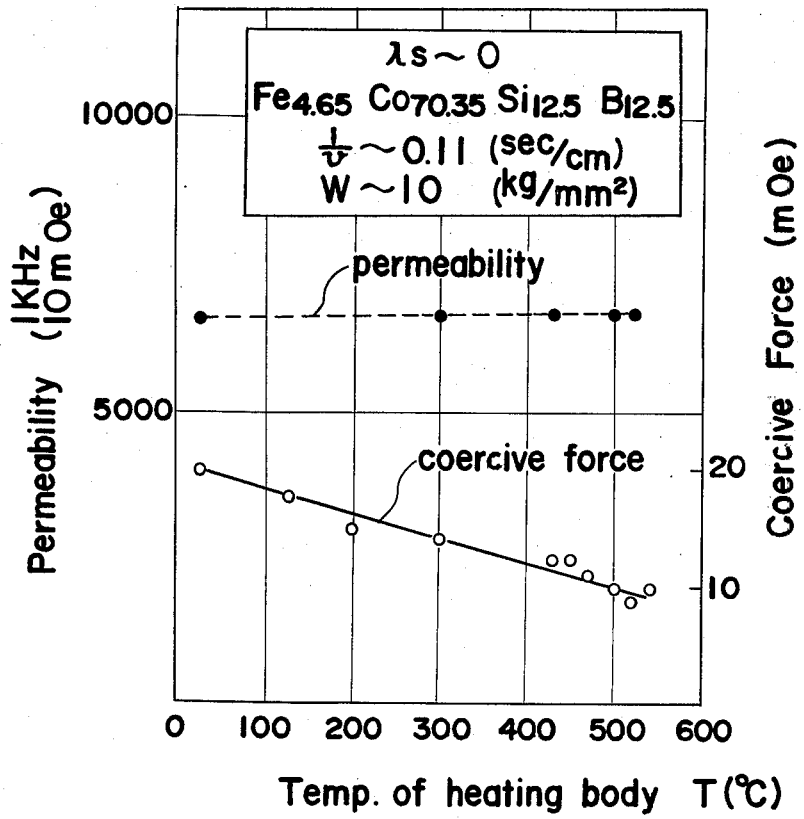
FIG. 4 is a graph particularly showing variations of the magnetic property characteristics of the amorphous alloy ribbon of $\lambda_s \sim 0$ with respect to the change of temperature of the heating body in the course of the heat treatment of the present invention.
Figure 5:
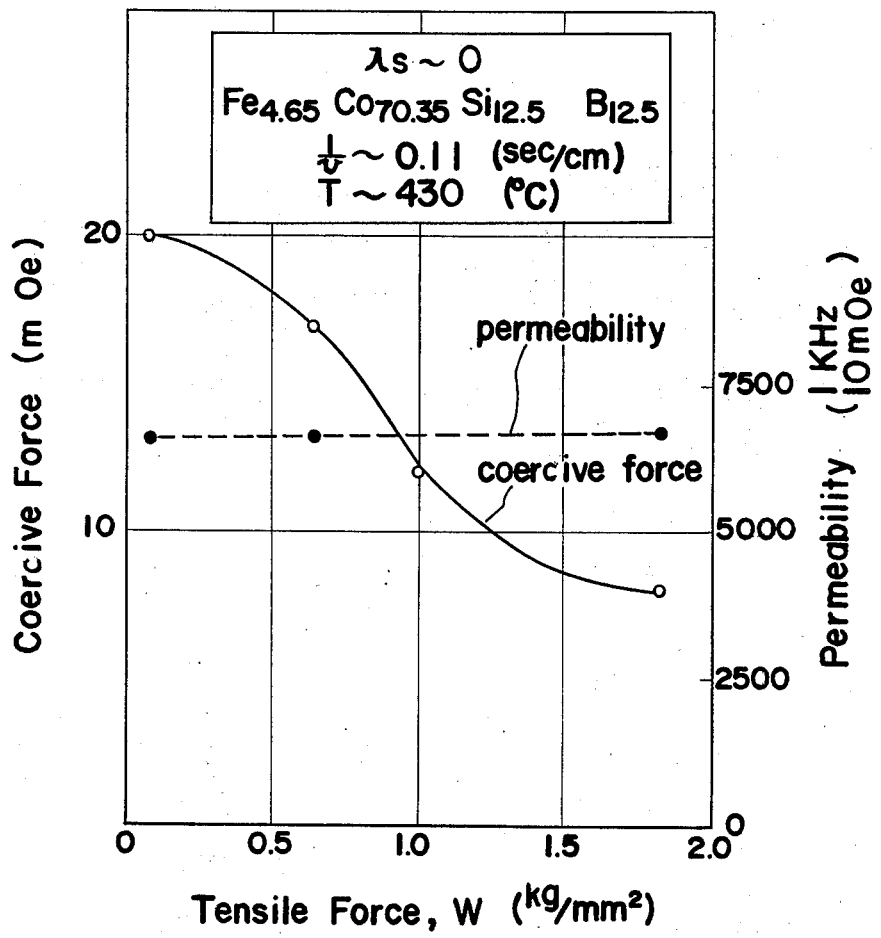
FIG. 5 is a graph particularly showing variations of the magnetic property characteristics of an amorphous alloy ribbon of $\lambda_s \sim 0$ with respect to the change of tensile force applied in the course of the heat treatment of the present invention.
Figure 6:
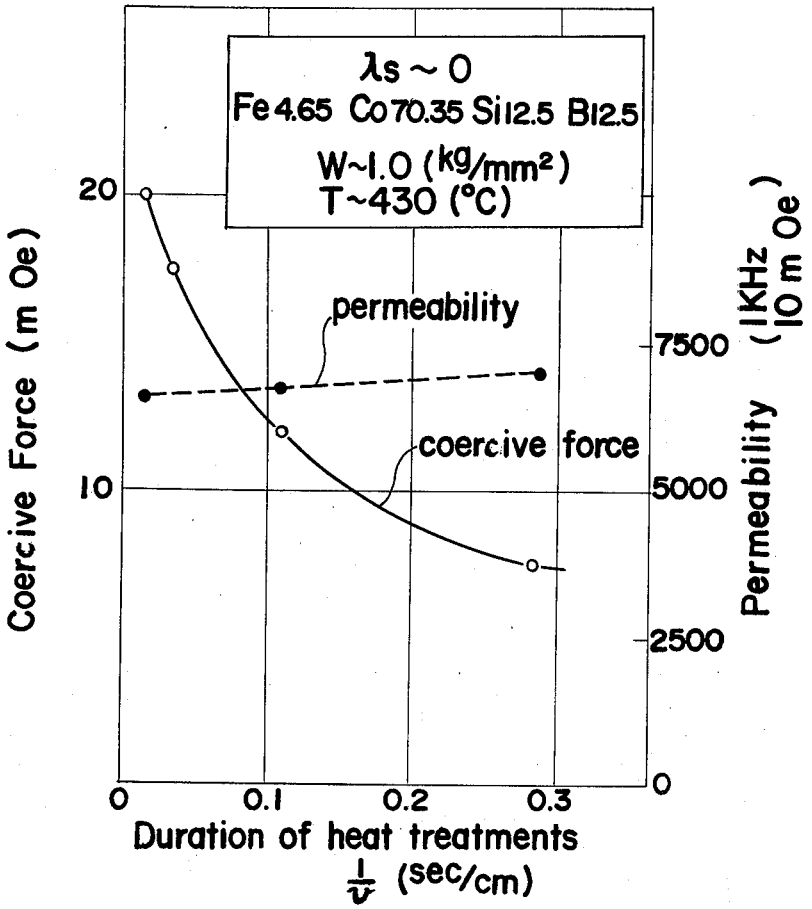
FIG. 6 is a graph particularly showing variations of the magnetic property characteristics of an amorphous alloy ribbon of $\lambda_s \sim 0$ with respect to the change of duration of the heat treatment of the present invention.

For a sample-material of $\lambda_s \sim 0$, an amorphous alloy ribbon having a high permeability, and a composition of $Fe_{4.65}Co_{70.35}Si_{12.5}B_{12.5}$ was employed. The dimensional characteristics of the sample material mentioned above was 4.6 mm in width, and 50 $\mu$m in thickness, respectively. With the sample-material mentioned above, the experiments were carried out by changing the heat treatment temperature or more strictly, the temperature of the heating body (T), the tensile force (W), and the duration of treatment (time necessary for causing the unit length of ribbon to pass through the heating body, 1/v; wherein v is the transferring speed of the ribbon). Referring now to FIG. 4, there is shown an experimental result showing the variations of the respective coercive force and permeability (1 KHz. 10mOe) of the sample-material with respect to the change of heat-treatment temperature, more strictly, the temperature of the heating body (T), with the tensile force (W) together with the duration of heat treatment (1/V) being maintained constant. Referring to FIG. 5, there is shown an experimental result demonstrating the variation of the respective coercive force and the permeability of the sample-material mentioned above with respect to the change of the tensile force (W), with the heat-treatment temperature (T) together with the duration of heat treatment (1/v) being maintained constant. Referring to FIG. 6, there is shown an experimental result representing the variations of the respective coercive force and permeability of the sample-material mentioned above with respect to the change of the duration of heat-treatment (1/v), with the heat-treatment temperature (T) together with the tensile force (W) being maintained constant. As for the sample-material of $\lambda_s \sim 0$, the coercive force is decreased following the increase of the temperature. More specifically, the coercive force is enhanced from 20 mOe to approximately 10 mOe of the crystallization point temperature state. On the contrary, the permeability is increased very little, i.e., from 6580 to 6710. The same effects mentioned above are alternatively obtained when either W or 1/v is varied. With the present embodiment, since the duration of heat-treatment is quite short, the sample-material can not be rendered brittle, even if the heat-treatment of the sample-material is accomplished at a temperature more than the crystallization point temperature thereof.

When the present invention is to be carried out on a technological scale (in consideration of the working efficiency concerned and the stable high-speed transferring operation together with taking-up operation of the amorphous alloy ribbons without including the defective portion described in the foregoing) the temperature of the heating body is so arranged to be between a temperature of more than 250° C. which is lower than the crystallization point temperature ($T_{cry}=450°$ C.) by 200° C. and a temperature less than 500° C. which is higher than the crystallization point temperature by 50° C.

This is due to the fact that when the temperature of heating body exists in the temperature range less than ($T_{cry}-200°$ C.), the heat-treatment duration is to be prolonged and thereby, the working efficiency is degraded. However, on the contrary, when the temperature of the heating body exceeds the temperature of ($T_{cry}+50°$ C.), the undesirable situation occurs in which the amorphous alloy ribbon may be brought into a crystallization state during the heat treatment.

EXAMPLE 2

For a sample-material of $\lambda_s < 0$, an amorphous alloy ribbon having a composition of $Fe_{4.3}Co_{70.7}Si_{12.5}B_{12.5}$ was employed.

Figure 7:
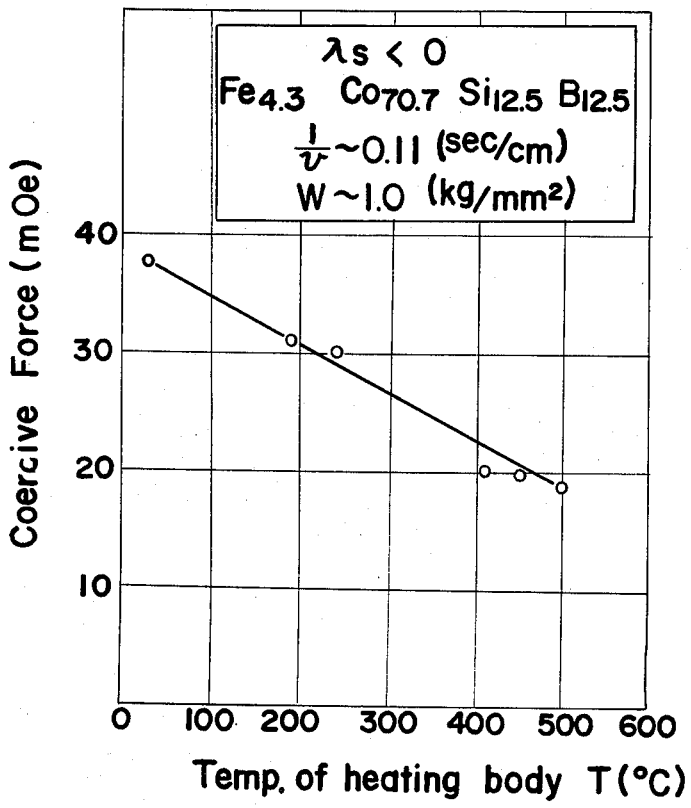
FIG. 7 is a graph particularly showing the variation of magnetic property characteristics of an amorphous alloy ribbon of $\lambda_s < 0$ with respect to the change of temperature of the heating body in the course of the heat treatment of the present invention.

Referring now to FIG. 7, there is shown the experimental results demonstrating the variation of the coercive force of the sample-material mentioned above with respect to the change of the heat-treatment temperature (T), with the tensile force (W), together with the duration of the heat-treatment (1/v), being maintained constant. As is clear from the figure, the variation trend of the coercive force of this sample-material is almost the same as that of the sample-material of $\lambda_s \sim 0$ described in the foregoing. Furthermore, as for the permeability of this sample-material, the same effect on the permeability of this sample-material is also brought about with respect to the increase of the heat-treatment temperature as was found in respect to the sample-material of EXAMPLE 1 described in the foregoing.

EXAMPLE 3

For a sample-material of $\lambda_s < 0$, an amorphous alloy ribbin having a composition of $Co_{70}Si_8B_{14}$ was employed.

Although the sample-material mentioned above was heat-treated under such experimental conditions of such that the duration of heat-treatment $(1/v) \sim 0.11$ (sec/cm); the heat-treatment temperature $\sim 350°$ C.; the tensile force $(W) \sim 0.63$ Kg/mm$^2$, and the coercive force of the present sample-material was almost unchanged; only varying from the initial value of 23 mOe to the final value of 22 mOe.

EXAMPLE 4

For a sample-material of $\lambda_s > 0$, an amorphous alloy ribbon having a composition of $Fe_{4.8}Co_{70.2}Si_{12.5}B_{12.5}$ was employed.

Figure 8:
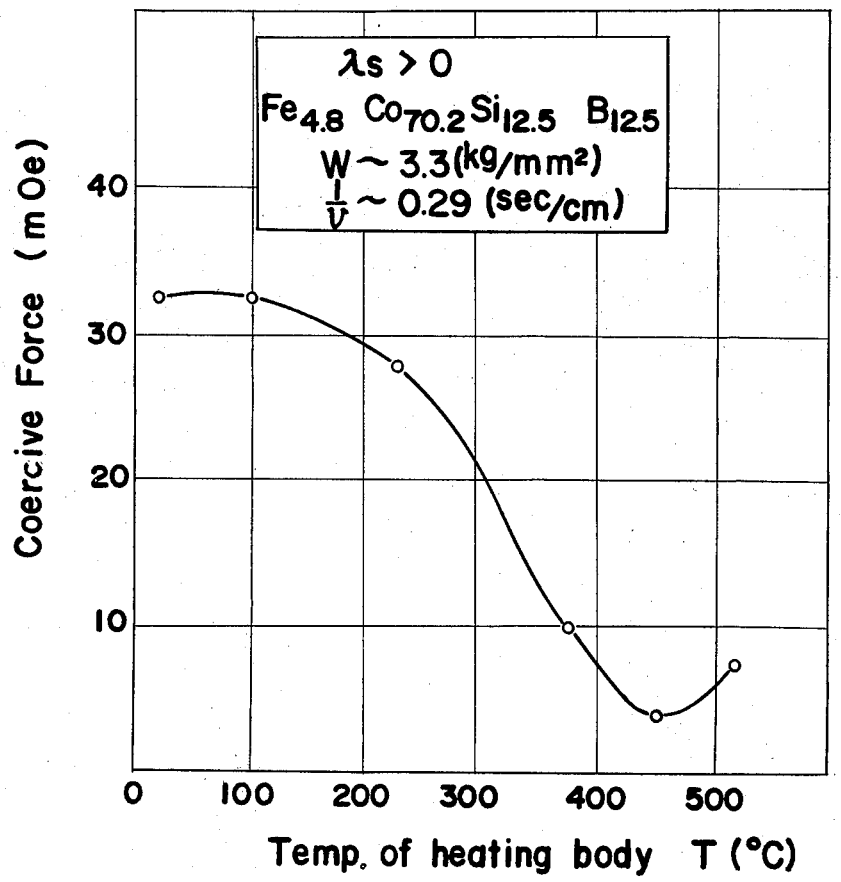
FIG. 8 is a graph particularly showing the variation of the magnetic property characteristic of the amorphous alloy ribbon of $\lambda_s > 0$ with respect to the change of temperature of the heating body in the course of the heat treatment of the present invention.

Referring now to FIG. 8, there is shown results demonstrating the variation of the coercive force of the sample-material mentioned above with respect to the change of the heat-treatment temperature (T), with the duration of heat-treatments (1/v) together with the tensile force (W) showing the values of $1/v \sim 0.28$ sec/cm and $W \sim 1.0$ Kg/mm$^2$ respectively.

EXAMPLE 5

For a sample-material of $\lambda_s \sim 0$, an amorphous alloy ribbon having the composition of $(Fe_{4.65}Co_{70.35})$(78/75-)$Si_{11}B_{11}$ was employed. This sample-material was heat-treated under such experimental condition that the heat-treatment temperature $(T) = 440°$ C., the duration of heat-treatment $(1/v) = 0.28$ sec/cm, and the tensile force $(W) = 1.0$ Kg/mm$^2$, respectively.

According to the experimental results of this example, the value of the coercive force was varied from the initial value of 33 mOe to 13 mOe, while the value of the permeability of the sample-material was varied from the initial value of 3524 to 4220 due to the heat-treatments of the present invention.

EXAMPLE 6

For a sample material of $\lambda_s \sim 0$, an amorphous alloy ribbon having the composition $Fe_{4.65}Co_{70.35}Si_{12.5}B_{12.5}$ was employed.

Figure 9:
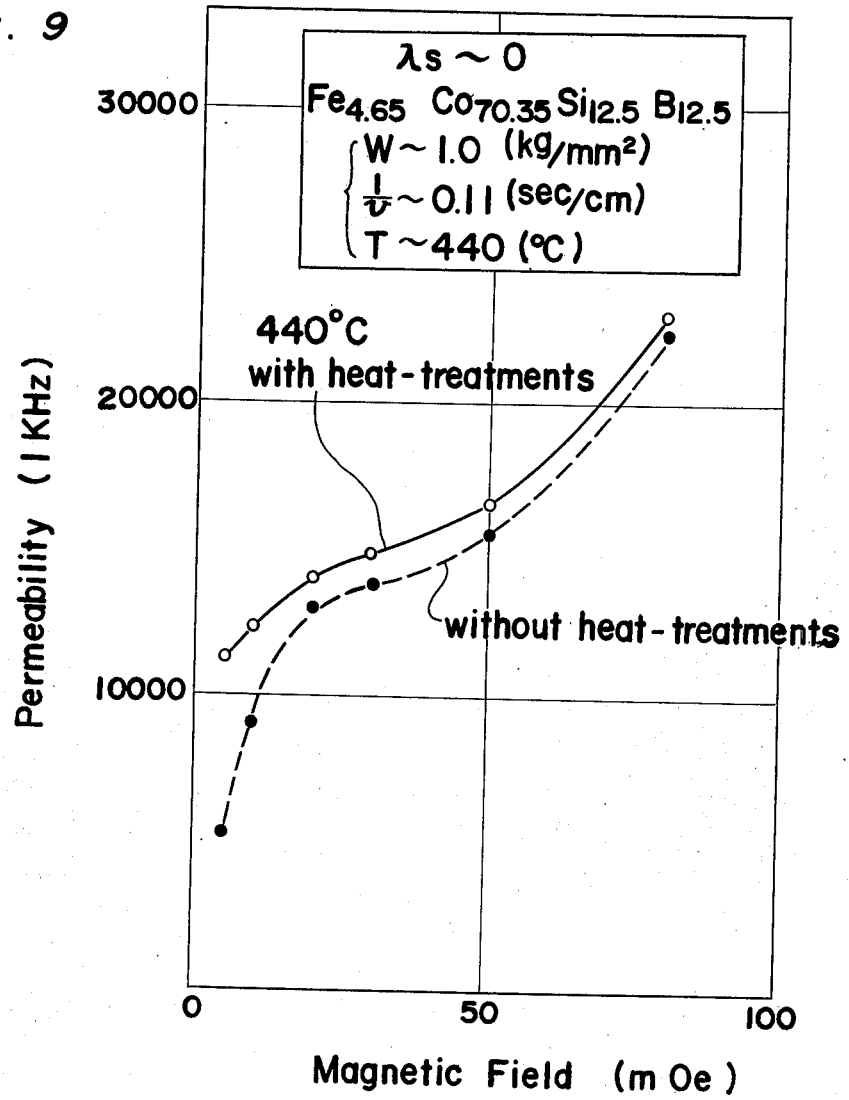
FIG. 9 is a graph particularly showing the variation of the specific level characteristics of permeability of an amorphous alloy ribbon of $\lambda_s \sim 0$ heat-treated by the method of the present invention together with that of an amorphous alloy ribbon without heat treatment in respect to the change of magnetic field applied.

Referring now to FIG. 9, there is shown an experimental result demonstrating the variation of the specific level characteristics of permeability of the sample-material heat-treated by the method of the present invention together with that of the sample-material without heat treatment with respect to the change of magnetic field applied under a heat-treatment temperature of $(T) \sim 440°$ C., and wherein the duration of the heat-treatment is $(1/v) \sim 0.11$ sec/cm, and the tensile force $(W) \sim 1.0$ Kg/mm$^2$, respectively.

As is clear from the experimental results shown in this figure, the permeabilities of the sample-material heat-treated at a temperature of 440° C. lay, as a whole, higher than those of the sample-material without heat-treatments, and more specifically, the enhancement of the permeability of the sample-material heat-treated is especially prominent in the low range of magnetic field.

EXAMPLE 7

In this embodiment of the present invention, with the help of the device of a rolling type shown in FIG. 1(*b*), an amorphous alloy ribbon of $\lambda_s \sim 0$ was heat-treated at a temperature $(T) \sim 150°$ C. with the duration of the heat-treatment of $(1/v) \sim 1$ sec/cm, whereby the initial value of the coercive force of 20 mOe of a sample material was changed to 18 mOe.

EXAMPLE 8

Figure 10:
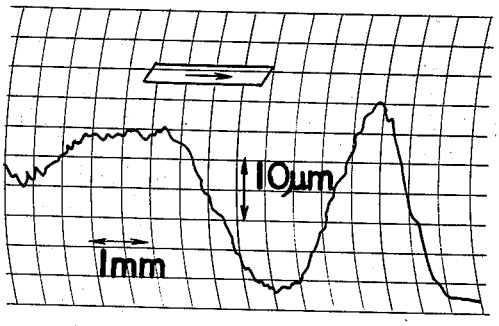
FIGS. 10(*a*) and (*b*) are graphs particularly showing the surface state of the amorphous alloy ribbon without heat treatments (a), and that of the amorphous alloy ribbon heat-treated by the method of the present invention (b).
Figure 10:
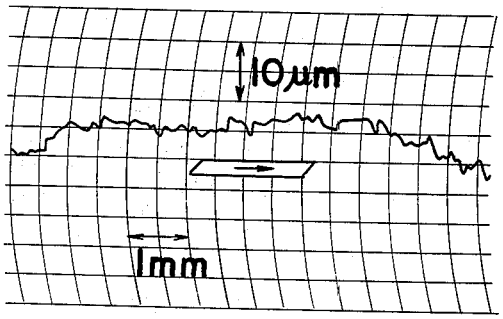

Referring now to FIG. 10, there is described the surface state of an amorphous alloy ribbon without heat-treatments (a), and that of an amorphous alloy ribbon heat-treated by the method of the present invention (b).

As is clear from the comparison between these two figures, the surface roughness of the ribbon is quite effectively diminished by the heat-treatment method of the present invention. More specifically, the roughness of surface in the longitudinal direction ribbon, which is specifically shown by a plurality of steep fluctuations in FIG. 1(a), is averaged to provide a smooth surface as shown in FIG. 1(*b*).

The experimental conditions for the above-mentioned heat-treatment of the amorphous alloy ribbon were as follows: viz., the heat-treatment temperature (T)was $\sim 440°$ C., the tensile force (W)was $\sim 1$ Kg/mm$^2$, and the duration of heat-treatments (1/v)was $\sim 0.28$ sec/cm, respectively.

EXAMPLE 9

In this embodiment, as for a sample material, a ribbon of magnetic amorphous alloy manufactured with the help of the device of single roller type and formed in the dimensions of 10 mm in width, 30–40 $\mu$m in thickness and 6 m in length was employed.

The free surface of the sample material of ribbon was being ground by mechanical grinding means including the grindingstone 16 (Japanese Industrial Standards (JIS R 2610-1954) G. C. Grindingstone #120-grit) with the ribbon being fed to contact with the grinding surface of the grindingstone at a speed of about 2 cm/sec, to cause the width of the ribbon mentioned above to be uniformly reformed in 20 $\mu$m. The resulting thickness of the ribbon was finished in the range of $20\mu \pm 2$ $\mu$m.

Successively, the ribbon mentioned above was transferred forward at the same transferring rate of about 2 m/sec so as to contact with a heating body 6, for annealing, which constitutes a part of the heat-treatment step of the present invention and was arranged to be at a predetermined temperature of 400° C. Due to the transfer of the ribbons together with the simultaneous contacting of the ribbon with the heating body 6 for annealing, a ribbon having been curled in the width direction thereof was uniformly flattened.

EXAMPLE 10

A sample-material of an amorphous alloy ribbon manufactured with the help of the device of single roller type and having the dimensions of 20 mm in width, 30–50 μm in thickness and 10 m in length was treated in the same manner as described in EXAMPLE 9. However, according to this example, the ribbon mentioned above was fed in a forward direction at a speed of 1 cm/sec with the free surface being ground by electro-grinding, and the resultant ribbon having a thickness of 20 μm (±2 μm) was continuously transferred at the same rate, to contact the heating metal body for annealing, which heating body was maintained at a predetermined temperature of 400° C. Consequently, a ribbon having the dimensions of 20 mm in width together with 20 μm (±2 μm) in thickness was obtained. Moreover, the curling existing on the surface of ribbon before heat-treatment was removed by the heat-treatment of the present invention.

EXAMPLE 11

The value of magnetostriction of the sample-material prepared for EXAMPLE 9 has approximate 0, i.e., $\lambda_s \sim 0$, and the magnetic properties of the sample-material mentioned above were enhanced by both reforming and annealing of the present invention as described hereinbelow.

Before the reforming and annealing of the sample-material:

$$\mu(1\ \text{KHz}, 10\ \text{mOe}) \sim 12{,}000,\ Hc \sim 0.02\ \text{Oe}.$$

After the reforming and annealing of the sample-material:

$$\mu(1\ \text{KHz}, 10\ \text{mOe}) \sim 20{,}000,\ Hc \sim 0.01\ \text{Oe}.$$

Accordingly, the method of the present invention described in the foregoing, can provide the most favorable method for the simultaneous accomplishment of grinding and heat-treatment of amorphous alloy ribbons.

According to the present invention, the method mentioned above comprises the sequential steps of; grinding the amorphous alloy ribbon continuously fed at a predetermined speed, to uniformly surface it, and successively, heat-treating or annealing the ribbon with its surface contacting the heating body kept at a predetermined temperature, to uniformly enhance the magnetic properties of the ribbon, whereby, irrespective of the length of the object to be heat-treated, the time-duration of the heat-treatment of the amorphous alloy ribbon under a predetermined tensile force can be strictly controlled without causing any non-uniformity in the heat-treatment.

Furthermore, as for the most prominent effect of the method of the present invention (in spite of the fact that the ribbon mentioned above is to be heat-treated by contact with a heating body having a temperature more than the crystallization point temperature of the ribbon to be heat-treated) it was found through the X-ray diffraction method that the transfer of the amorphous state to the crystallization state does not occur thanks to the characteristic short duration of heat-treatment arranged in advance. Moreover, according to the method of the present invention, the mechanical properties of the amorphous alloy ribbons manufactured through the splat cooling method themselves are maintained unchanged, and this fact is quite advantageous, as far as the amorphous alloy ribbons are concerned.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A method of heat treating an amorphous alloy ribbon manufactured by a splat cooling method, which comprises continuously transferring said amorphous alloy ribbon at a rate between 1 cm/sec and 50 cm/sec between two stations; contacting the ribbon with at least one heating body intermediate the two stations so that at least one surface of the ribbon directly contacts the heating body during the transfer step, said heating body being maintained at a temperature range (T°C.) which includes the crystallization point temperature $T_{cry}$°C. of said amorphous alloy ribbon such that the alloy is maintained in an amorphous state, such heat treatment being conducted for a time sufficient to enhance the magnetic properties of the alloy while maintaining the alloy in an amorphous state, wherein said temperature (T°C.) can be defined by the following relationship of $(T_{cry}-200°\ C.) \leqq T \leqq (T_{cry}+50°\ C.)$.

2. A method of heat treating the amorphous alloy ribbon as claimed in claim 1, wherein said heating body is in a fixed state and the ribbon is moved across the heated body.

3. A method of heat treating the amorphous alloy ribbon as claimed in claim 1, wherein the heating body is capable of rotating with respect to the relative transferring movement of the amorphous alloy ribbon over the heated surface of the heated body.

4. A method of heat treating the amorphous alloy ribbon as claimed in claim 1, wherein the heating body is at least one roller of a paired roller combination.

5. A method of heat treating an amorphous alloy ribbon as claimed in claim 1, which comprises a further step of grinding said amorphous alloy ribbon prior to the heat treatment, said step of grinding being performed prior to the heat treatment of the amorphous alloy ribbon, said grinding being performed in a continuous manner such that the ribbon is ground and heat treated without interrupting the transfer movement of the amorphous ribbon between stations, wherein said step of grinding includes a grinding wheel and a supporting stock underneath thereof, said supporting stock having a vertical angle ($\theta$) ranging between $10° \leqq \theta \leqq 150°$.

6. A method of heat treating an amorphous alloy ribbon according to claim 1 which comprises continuously transferring an amorphous alloy ribbon between a supply reel and a take-up reel across at least one heating body interposed between the supply reel and the take-up reel, such that at least one surface of the ribbon contacts the heating body.

7. A method of heat treating an amorphous alloy ribbon as claimed in claim 1, wherein the duration of heat treatment with said heating body is between 1 sec/cm and 0.02 sec/cm.

* * * * *